United States Patent [19]

Recher et al.

[11] Patent Number: 4,993,740

[45] Date of Patent: Feb. 19, 1991

[54] PROCESS FOR FORMING A SKI, AND A SKI FORMED ACCORDING TO THE PROCESS

[75] Inventors: Gilles Recher; Maurice Legrand, both of Annecy, France

[73] Assignee: Salomon S.A., Annecy Cedex, France

[21] Appl. No.: 330,280

[22] Filed: Mar. 29, 1989

[30] Foreign Application Priority Data

Mar. 29, 1988 [FR] France ..... 88 04481

[51] Int. Cl.[5] ..... A63C 5/04; A63C 5/12

[52] U.S. Cl. ..... 280/610; 264/257

[58] Field of Search ..... 280/601, 602, 608, 609, 280/610; 264/257

[56] References Cited

U.S. PATENT DOCUMENTS

| | | | |
|---|---|---|---|
| 3,635,483 | 1/1972 | Barriball et al. | 280/610 |
| 4,270,768 | 6/1981 | Nakanishi | 280/610 |
| 4,518,453 | 5/1985 | Kiisler et al. | 280/610 X |
| 4,610,835 | 9/1986 | Ghavamikia | 264/255 X |
| 4,655,861 | 4/1987 | Kiss | 264/257 X |
| 4,816,329 | 3/1989 | Arnaud | 264/257 X |

FOREIGN PATENT DOCUMENTS

| | | | |
|---|---|---|---|
| 351412 | 7/1979 | Austria . | |
| 349366 | 10/1979 | Austria . | |
| 2424880 | 12/1975 | Fed. Rep. of Germany . | |
| 3628292 | 2/1987 | Fed. Rep. of Germany . | |
| 2148104 | 3/1973 | France . | |
| 2416024 | 10/1979 | France | 280/610 |
| 2596286 | 10/1987 | France . | |

*Primary Examiner*—Charles A. Marmor
*Assistant Examiner*—Brian L. Johnson
*Attorney, Agent, or Firm*—Sandler, Greenblum & Bernstein

[57] ABSTRACT

A ski having an outer appearance layer constituted by a sheet of thermodeformable material which is heat deformable during a molding process. The sheet of thermodeformable material forming the appearance layer is composed of at least one outer layer of a substantially transparent plastic material and an inner layer made from substantially opaque plastic material. The inner layer contains coloring agents defining a decoration or inscription which is visible from the exterior through the outer layer. The plastic materials forming the sheet of thermodeformable material are such that the melting point and the heat softening temperature of the material forming the outer layer is less than the melting point and the softening temperature of the material forming the outer layer is less than the melting point and the softening temperature of the material forming the inner layer. The molding process is also disclosed for producing such a ski. In the present invention, the inner decoration layer is not substantially deformed during the molding process.

11 Claims, 4 Drawing Sheets

PROCESS FOR FORMING A SKI, AND A SKI FORMED ACCORDING TO THE PROCESS

BACKGROUND OF THE INVENTION

1. Field of the Invention

The present invention relates to a process of manufacturing a ski having an upper decorated surface.

2. Description of Background and Relevant Information

Skis utilized in winter sports, for example, and adapted to slide on snow and ice, generally comprise a lower sliding surface joined to two lateral surfaces along two lower edges provided with metallic corners, the lateral surfaces being connected to an upper surface.

For aesthetic reasons, the upper surfaces, and even the lateral surfaces, are decorated. Traditionally, the decoration of the upper surface of a ski is created by a silk-screen process. However, it is more difficult to decorate the lateral surfaces. Further, the decoration is fragile and is directly exposed to shocks and attack from external sources.

Skis are known to be manufactured by a hot molding process during which thermodeformable layers of material are deformed. To ensure the protection of the decoration during such a process, an appearance layer can be utilized which is made from a sheet of thermodeformable material composed of at least one outer layer made from a first plastic material which is substantially transparent, and an inner layer made out of a second plastic material which provides a contrast and which is substantially opaque, the inner layer containing coloring agents defining a decoration which is then visible through the outer layer.

The inventors have observed that, in attempting to mold a ski comprising such a sheet of thermodeformable material having two layers, the inner layer bearing the decoration tends to deform during molding, the material tending to flow particularly adjacent the breaks, or discontinuities, in the flatness of the planar surface of the ski, such as the upper edges of the ski, which causes a deformation of the decoration and, thus, defects in appearance. At the same time, however, it is required that the upper layer perfectly mate with the mold, in particular the edges and the reliefs carried onto the surface, which are generally obtained by making the material flow within the mold.

SUMMARY OF THE INVENTION

It is an object of the present invention, therefore, to provide a ski having an outer appearance layer constituted by a sheet of thermodeformable material which is heat deformable during a molding process, the sheet of thermodeformable material forming the appearance layer being composed of at least one outer layer of a substantially transparent plastic material and an inner layer made from substantially opaque plastic material. The inner layer contains coloring agents defining a decoration which is visible from the exterior through the outer layer, and the plastic materials forming the sheet of thermodeformable material are such that the melting point and the heat softening temperature of the material forming the outer layer is less than the melting point and the softening temperature of the material forming the inner layer.

The melting point and the softening temperature of the material forming the outer layer and a predetermined molding temperature used to mold the ski preferably have a difference less than or equal to about 10° C.

Further, the melting point and the softening temperature of the material forming the inner layer and the predetermined molding temperature have a difference between 15° and 20° C.

Still further, the melting point and the softening temperature of the material forming the inner layer is selected to be approximately 15° C. or more above the predetermined molding temperature.

Still further, the melting point and the softening temperature of the material forming the outer layer is no greater than about 10° C. above the predetermined molding temperature.

According to one preferred embodiment of the invention, the inner layer is constituted by a polyamide, and the exterior layer is a mixture of polyamide and polyether block-amide of the PEBAX type.

The ski according to the invention comprises an upper surface, two lateral surfaces, and a decoration extending in a substantially continuous manner on the upper surface and on the lateral surfaces of the ski, and the lateral surfaces of the ski are connected to the upper surface of the ski along two relatively sharp edges.

Further, the outer layer of the ski comprises at least one discontinuity such as an edge or corner. In this connection, the upper surface of the ski includes two longitudinal ribs formed by flowing of the material of the outer layer during molding.

The ski according to the invention can be further defined as including an appearance layer made of thermodeformable material having a layer of an at least partially transparent material and an inner layer made from substantially opaque material. The inner layer contains coloring agents defining a decoration or inscription which is visible from the exterior through the transparent layer. The materials forming the thermodeformable material are such that the melting point and the heat softening temperature of the material forming the transparent layer is less than the melting point and the softening temperature of the material forming the inner layer.

According to one preferred embodiment, the inner layer is made of a polyamide, and the transparent layer is made of a block copolymer of ether and amide.

The present invention also includes the method of manufacturing a ski including:

(a) preparing a subassembly by assembling a first thermodeformable layer and a second thermodeformable layer together, the second layer to be interior of the first layer in the manufactured ski;

(b) preheating the subassembly;

(c) heating a mold to within a predetermined temperature range;

(d) placing a core and the subassembly within the mold;

(e) maintaining the core and subassembly within the mold for a predetermined amount of time at a predetermined temperature and pressure so as to permit the first layer to flow within the mold to substantially assume a predetermined contour, and to not substantially permit the second interior layer to flow within the mold; and (f) removing the core and subassembly from the mold.

The method according to the invention further includes, according to a preferred embodiment, before the assembly is placed within the mold, the step of providing a decoration or inscription on the second, interior layer.

According to one embodiment, the step of providing a decoration or inscription includes printing same on the second, interior layer.

According to a further embodiment, the step of preparing a subassembly further includes assembling an inner reinforcement layer and a filling layer to the first layer and the second layer.

The step of preheating includes, according to one embodiment, preheating the subassembly with an infrared heat source.

Alternatively, the step of preheating includes placing the subassembly on the mold, whereby the subassembly is preheated by conduction or radiation from the mold.

Preferably, according to the invention, the step of heating the mold includes heating the mold to approximately 120°-145° C.

The method of the invention further includes, prior to the step of preparing the subassembly, the step of selecting the first layer and the second layer such that the melting point and the heat softening temperature of the material forming the outer layer is less than the melting point and the softening temperature of the material forming the second, interior layer.

Preferably, the melting point of the second, interior layer is selected to be approximately 15° C. or more above the temperature of the mold. Further, the melting point of the first layer is selected to be approximately 10° C. above the temperature of the mold.

The predetermined contour of the mold preferably includes at least one discontinuity and the step of permitting the first layer to flow includes permitting the first layer to flow within the discontinuity.

The first layer is selected to be substantially transparent according to the invention. The second interior layer is selected to have a decoration or inscription thereon which can be seen through the first, substantially transparent layer.

The invention further includes the ski manufactured according to the above method, wherein the second, interior layer comprises a decoration or inscription, and wherein the decoration or inscription is not substantially deformed due to the second, interior layer substantially not being permitted to flow during the method.

BRIEF DESCRIPTION OF THE DRAWINGS

Other objects, characteristics, and advantages of the present invention will become clear from the following description of particular embodiments provided with reference to the annexed drawings in which.

DETAILED DESCRIPTION OF PREFERRED EMBODIMENTS

An object of the present invention is to provide a ski in which the decoration of the upper surface, and the lateral surfaces as well, are protected against deterioration from external sources.

Further, the invention is directed to a ski manufacturing process truly adapted to modern materials, and which is particularly simple and inexpensive. According to this process, a hot molding operation of an assembly is utilized, comprising in particular the upper appearance layer of the ski, the appearance layer being constituted by a sheet of thermodeformable material which is deformed while hot during the molding of the assembly. The softening point of the sheet of thermodeformable material forming the appearance layer is less than the molding temperature and, preferably, slightly less.

An object of the present invention is to obtain a satisfactory result, both from the point of view of the appearance of the decoration, as well as from the point of view of assembly, during manufacture, by molding a ski having an appearance layer whose decoration is carried by a subadjacent layer protected by an upper layer.

To achieve these objects as well as others, the plastic materials forming the sheet of thermodeformable material are selected in a manner such that the melting point and the heat deformation temperature of the first material forming the outer layer are respectively less than the melting point and the heat deformation temperature of the second material forming the inner layer and carrying the decoration. The melting point of the first material forming the outer layer is itself slightly greater than the molding temperature.

In particular, a difference which is less than or equal to about 10° C. between the molding temperature and the melting point of the first material forming the outer layer can advantageously be selected.

Likewise, a difference of about 15° C. and 20° C. between the molding temperature and the melting point of the second material forming the inner layer can preferably be selected.

A ski thus formed can have decoration, such as a model name or number or the manufacturer's name or mark, of acceptable quality even when the outer surface of the ski comprises breaks, or discontinuities, in the flatness of the planar surface such as longitudinal edges; and the decoration or inscription, can be achieved in a manner such that it is continuous and without interruption between the upper surface of the ski and its lateral surfaces.

Figures 1, 2:
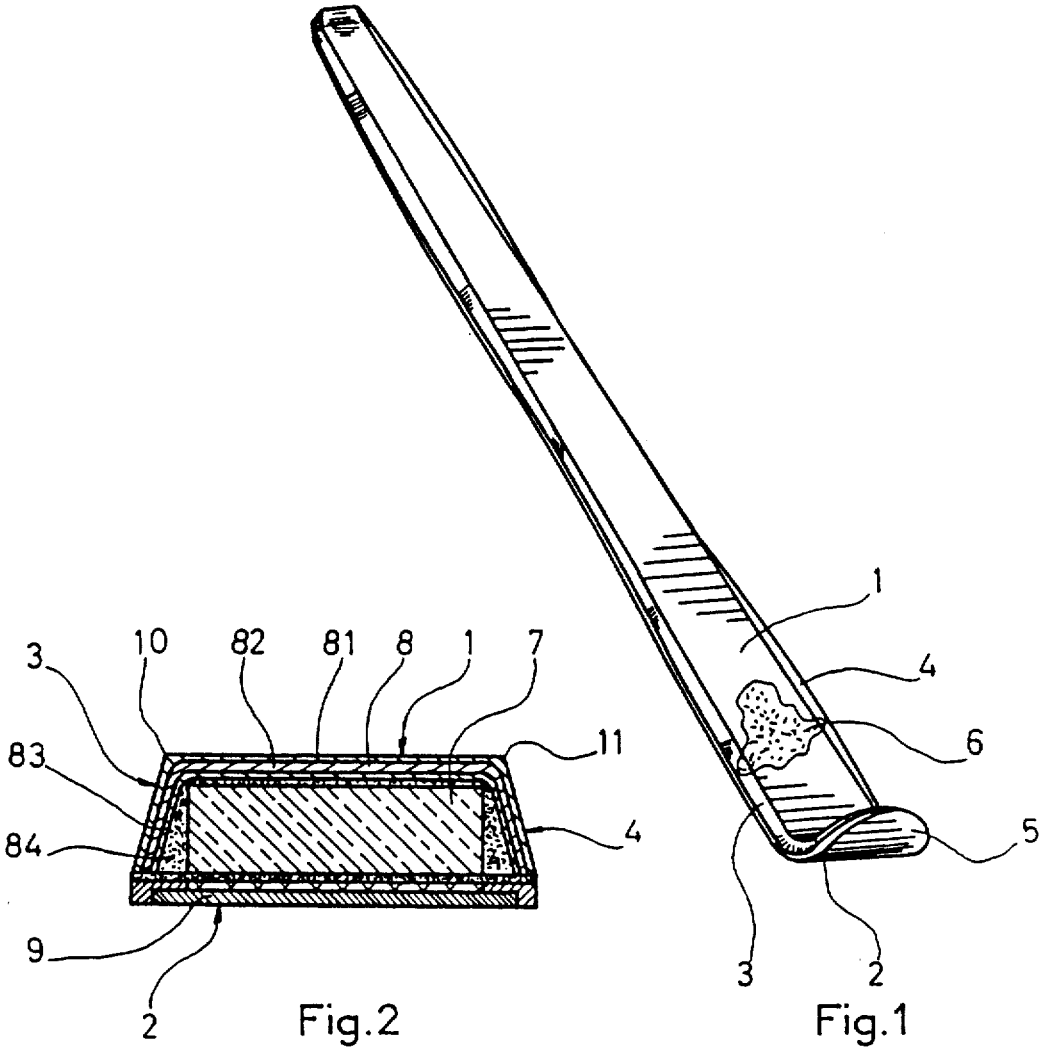
FIG. 1 shows a perspective view of a ski decorated according to the present invention.
FIG. 2 shows a structural example of a ski according to the present invention in transverse cross-section.

FIG. 1 shows a ski in perspective, which is formed according to the process of the present invention. This ski comprises, in a traditional manner, an upper surface 1, a lower or sliding surface 2, a first lateral surface 3, a second lateral surface 4, and an upwardly curved front end 5, in the form of a spatula. Decoration 6, schematically shown, is visible from the exterior of upper surface 1 as well as from the lateral surfaces 3 and 4.

FIG. 2 shows, in transverse cross-section, a ski according to one embodiment of the invention. This ski includes the following three principle portions: a core 7, a shell 8, and a lower element 9. The interior ski structure by the ski, without going beyond the scope of the present invention, can be constituted by very diverse composite elements, to the extent that these elements are compatible with the hot molding process. Thus, the core 7 must preferably be formed from a material whose melting temperature is substantially greater than the molding temperature. On the other hand, the material forming the shell must be able to deform, under the effect of molding temperature and pressure forces exerted in the mold, as will be further described below.

Shell 8, according to the present invention, comprises at least two layers of plastic material, an outer layer 81, made out of a substantially transparent material, and an inner layer 82 made from a substantially opaque material. Layer 82 comprises coloring agents arranged in a pattern to produce decoration 6, the decoration being visible from the exterior through the outer layer 81. Thus, the outer layer 81 is a protective layer, whose possible deterioration under the effect of external agents does not fundamentally affect the appearance of decoration 6. The assembly formed by the outer layer 81 and an inner layer 82 form the appearance layer of the ski.

In the embodiment shown in FIG. 2, the shell 8 furthermore comprises an inner reinforcement layer 83 forming a casing. A filling material 84 fills the space between the inner reinforcement layer 83 and core 7.

In the embodiment which will be described below, the molding process according to the present invention makes it possible to produce the assembly formed by core 7 and shell 8 of the ski shown in FIG. 2. In this embodiment, the process involves the following different steps.

Figure 3:
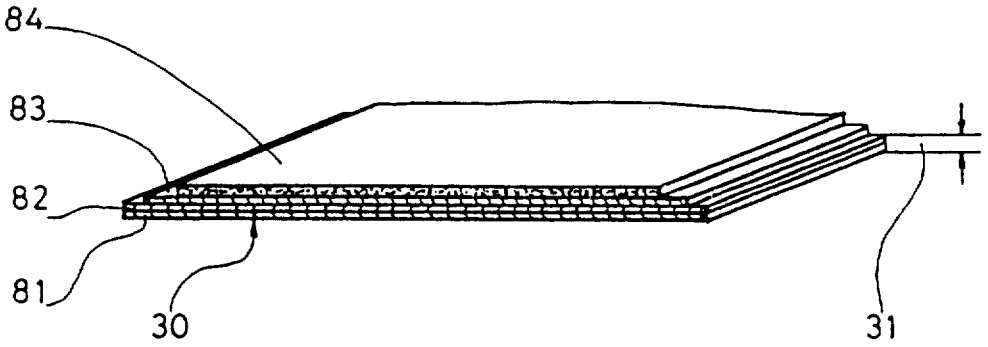
FIGS. 3-10 schematically illustrate the different phases of the process according to the invention.

In the course of the first step, illustrated by FIG. 3, one prepares a subassembly 30 which is constituted, by way of example, of a sheet 31 of thermodeformable material composed of two layers, an outer layer 81 made from a first plastic material, substantially transparent and an inner layer 82 made from a second plastic material which is substantially opaque. The outer layer 81 and the inner layer 82 are directly pressed and affixed against one another along a junction surface. Decoration 6 is formed by the incorporation of coloring agents, distributed in a sufficient manner, in the inner layer 82 adjacent the junction surface with the outer layer 81, or on both sides of the junction surface. For example, the incorporation of coloring agents can be achieved by a printing method by the transfer of sublimable inks from a decoration layout composed of sublimable coloring agents on a paper support. The printing method can proceed, for example, in the following manner.

The outer layer 81 and the inner layer 82 being assembled along their junction surface, the printed surface of a paper support is applied on the accessible surface of the inner layer 82 made of an opaque contrasting material. The coloring agents are then transferred by sublimation to the inner layer 82 by placing it under adequate conditions of temperature, pressure and time conditions, according to conventional methods used in the sublimation printing technique.

Preferably, the printing conditions are such that the coloring agents migrate until adjacent the surface of the junction between the inner layer 82 and outer layer 81.

The subassembly 30 is formed by adapting upon the double sheet 31, formed by layers 81 and 82, the other possible layers 83 and 84 adapted to form the shell 8.

Of course, one would not go beyond the scope of the invention by providing coloring agents within the inner layer 82 according to a process other than sublimation printing.

Figure 4:
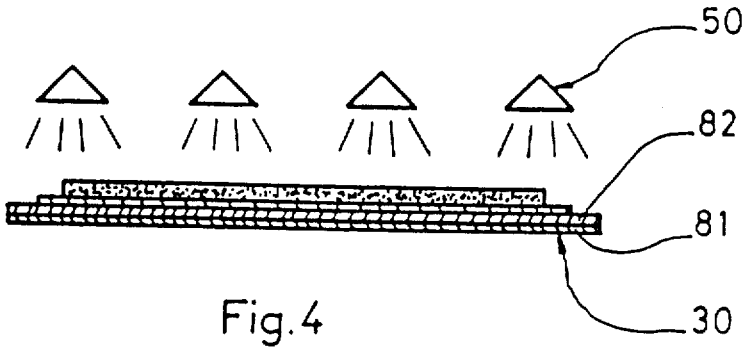

According to the second step of the process, illustrated in FIG. 4, the subassembly 30 is preheated to a sufficient temperature to allow for the achievement of the subsequent phases of the process. It is necessary to soften the subassembly 30 so that it can be deformed. In the embodiment shown in FIG. 4, the heating is obtained by separately heating subassembly 30 by infrared panels 50.

Figure 5:
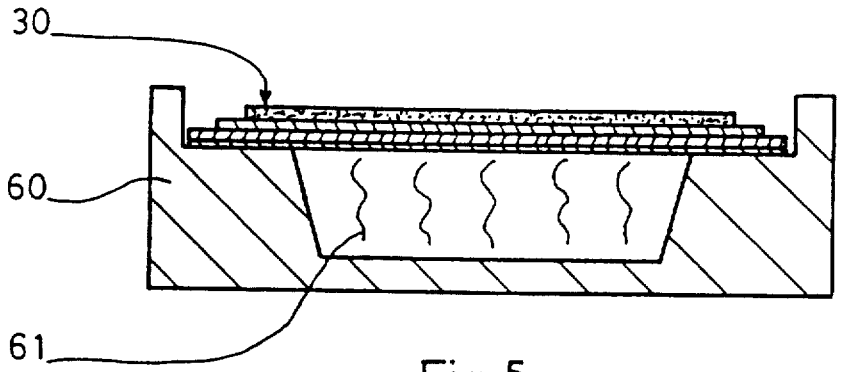

By way of an alternative, FIG. 5 illustrates another embodiment of this step, in which, after preheating of mold 60, subassembly 30 is placed on the mold as is shown in the figure, and it is the heat 61 of the mold, transmitted by conduction or radiation, which preheats the subassembly 30.

Figure 6:
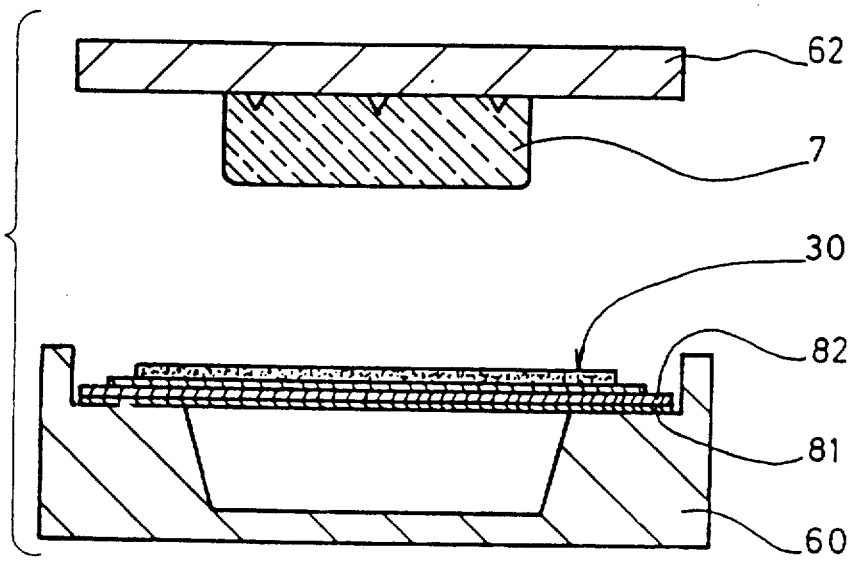
Figure 7:
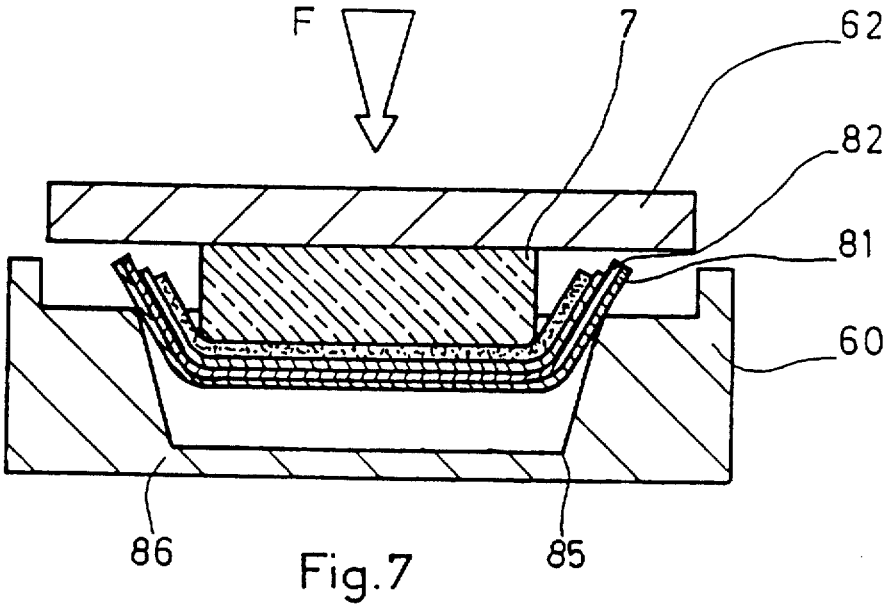

In the next step of the process, illustrated in FIG. 6, the mold is first heated to approximately 120°-145° C. The subassembly 30 is arranged in the mold as shown in the figure. By means of core 7, subassembly 30 is embedded in the mold (FIGS. 7-9) until its complete closure (FIG. 9). The assembly is maintained in the position shown in FIG. 9 for a sufficient amount of time to allow for the polymerization of the different materials. To this end, core 7 is affixed to cover 62 adapted to close the mold 60.

Figure 8:
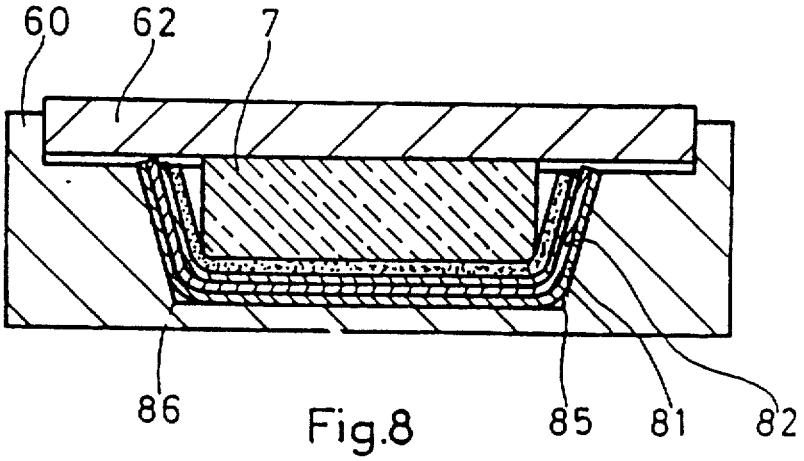
Figure 9:
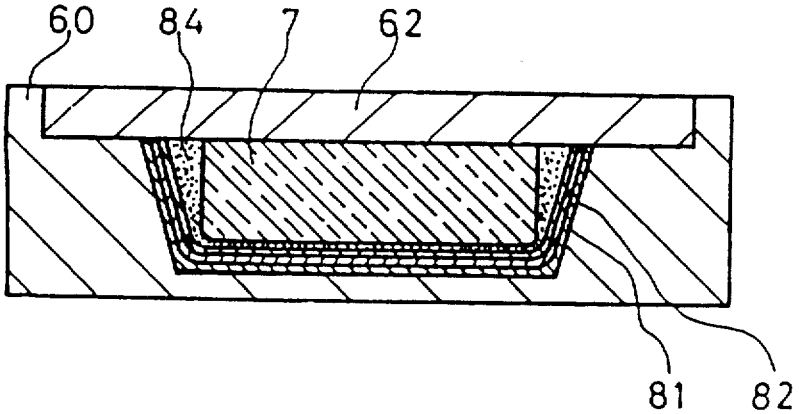

FIG. 8 shows an intermediate closure position of the mold. In this position, the different layers of the shell have been folded to assume the shape of the walls of the mold. It will be noted in this figure, however, that the outer layer 81 forms, in the zones of edges 85 and 86 of the mold, rounded surfaces which do not totally fill the angular shape of the edges. The filling is obtained by the flowing of the material forming the outer layer 81, under the combined effect of the molding temperature and the pressure exerted by cover 62. The flowing of the material forming the outer layer 81 thus permits, in the final molding phase shown by the passage between FIGS. 8 and 9, to very tightly mate the shape of the walls of mold 60.

During this flowing phase of the material constituting the outer layer 81, it is important that the decoration carried by the inner layer 82 is not altered. For this it is necessary, according to the invention, to avoid the flow of the material constituting the inner layer 82 when one passes from the step of FIG. 8 to the step shown in FIG. 9.

Figure 10:
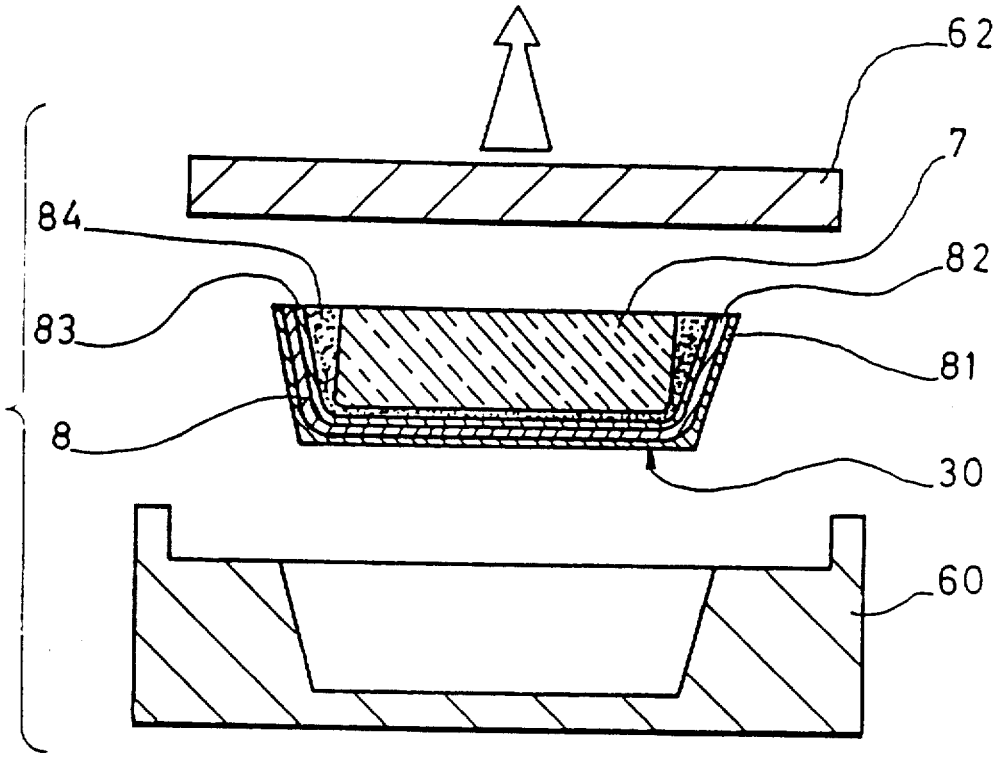

In FIG. 10, after cooling and opening of the mold, the subassembly of the ski formed by core 7 and its shell 8 is obtained. The lower element 9 of the ski shown in FIG. 2 can then be assembled, for example, by gluing or any other process, the lower element of the ski being constituted, for example, by a sole made out of polyethylene, of lateral edges made out of steel, and an inner reinforcement layer.

Of course, one would not go beyond the scope of the invention if the subassembly 30 were to be formed of only inner layer 82 and outer layer 81, or if the ski were to have a different internal structure.

An essential aspect of the present invention is to select in an appropriate manner the constitution of the outer layer 81 and the inner layer 82. To this end, the respective softening points of the materials forming the outer layer 81 and inner layer 82 are slightly less than the molding temperature. The plastic material forming the outer layer 81 has a heat deformation temperature which is less than that of the second material forming the inner layer 82. The melting point of the first material forming the outer layer is itself slightly greater than the molding temperature.

Preferably, the melting point of the inner layer 82 is selected to be approximately 15° C. or more above the molding temperature. Further, the melting point of the outer layer 81 is selected to be, at most, approximately 10° C. above the molding temperature.

In the case where one does not have available a plastic material having all of the characteristics required for the top of a ski and an appropriate melting point, one can modify this melting point by the addition of another plastic material.

For example, in the case of the top of the ski formed of a double layer sheet of polyamide, which can be molded at temperatures which can reach 170° C., the inner layer 82 can be polyamide 11, of the type distributed under the mark RILSAN B by ATO-CHEM. The transparent outer layer 81 could be a mixture of polyamide 11 and polyether block-amide of the type distributed under the name PEBAX, which makes it possible to lower the melting point and the softening temperature of the transparent outer layer to obtain the values desired, in this case approximately 175° C. and approximately 130° C., respectively.

The present invention makes it possible to provide decorations to the exterior surface of the ski in which the surface has substantial breaks in the flatness of the ski surface. Thus, in the embodiment of FIG. 12, the external surface comprises two substantial breaks in the flatness of the planar surface constituted by the two upper edges 10 and 11. The invention makes it possible to prevent the decoration carried by the inner layer 82 from being disturbed adjacent to the edges 10 and 11. In this embodiment, the lateral surfaces 3 and 4 of the ski are oblique.

Figure 11:
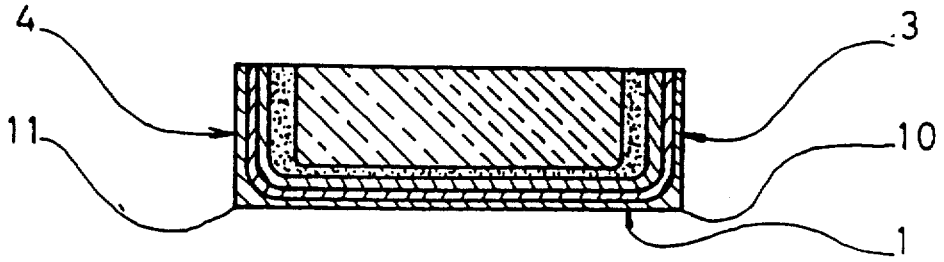
FIG. 11 shows an alternative molded structural assembly of a ski according to the present invention.

In the embodiment of FIG. 11, the lateral surfaces 3 and 4 of the ski are substantially perpendicular to the upper surface 1 such that the edges 10 and 11 substantially form a right dihedral.

Figure 12:
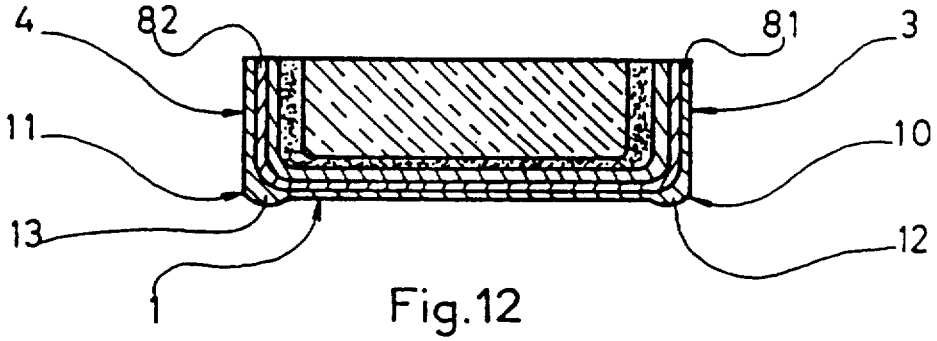
FIG. 12 shows another alternative of a molded structural assembly of a ski according to the present invention.

In the embodiment of FIG. 12, the upper surface 1 of the ski comprises two longitudinal ribs 12 and 13. The longitudinal ribs 12 and 13 can be useful, for example, for increasing the protection of the upper surface 1 of the ski. According to the invention, it is possible to achieve these upper edges 12 and 13 by the localized flowing of the material forming the outer layer 81 during the molding, without detracting from the quality of the decoration carried by the inner layer 82.

Although the invention has been described with reference to particular means, materials and embodiments, it is to be understood that the invention is not limited to the particular disclosure and extends to all equivalents within the scope of the claims.

What is claimed is: .

1. A ski comprising: an outer appearance layer comprising a sheet of thermodeformable material which is heat deformable during a molding process, said sheet of thermodeformable material forming said appearance layer being composed of at least one outer layer of a substantially transparent plastic material, having a melting point and a heating softening temperature, and an inner layer made from substantially opaque plastic material, having a melting point and a heat softening temperature, said inner layer containing coloring agents defining a decoration which is visible from the exterior through said outer layer, said plastic materials forming said sheet of thermodeformable material are such that the melting point and the heat softening temperature of the material forming said outer layer is less than the melting point and the heat softening temperature of the material forming said inner layer.

2. The ski according to claim 1, wherein said melting point and said softening temperature of said material forming said outer layer and a predetermined molding temperature used to mold said ski have a difference not greater than about 10° C.

3. The ski according to claim 2, wherein said melting point and said softening temperature of said material forming said inner layer and said predetermined molding temperature have a difference between 15° and 20° C.

4. The ski according to claim 1, wherein said melting point and said softening temperature of said material forming said inner layer is selected to be not less than about 15° above said predetermined molding temperature.

5. The ski according to claim 4, wherein said melting point and said softening temperature of said material forming said outer layer is no greater than about 10° C. above said predetermined molding temperature.

6. The ski according to claim 1, wherein said inner layer comprises a polyamide, and said outer layer is a mixture of polyamide and polyether block-amide of the PEBAX type.

7. The ski according to claim 1, further comprising an upper surface, two lateral surfaces, and a decoration extending in a substantially continuous manner on said upper surface and on said lateral surfaces of said ski, and wherein said lateral surfaces of said ski are connected to said upper surface of said ski along two relatively sharp edges.

8. The ski according to claim 1, wherein said outer layer of said ski comprises at least one discontinuity.

9. The ski according to claim 8, comprising an upper surface having two longitudinal ribs formed by flowing of the material of the outer layer during molding.

10. A ski comprising an appearance layer made of thermodeformable material which is heat deformable during a molding process, comprising a layer of an at least partially transparent material, having a melting point and a heat softening temperature, and an inner layer made from substantially opaque material, having a melting point and a heat softening temperature, said inner layer containing coloring agents defining a decoration which is visible from the exterior through said partially transparent layer, said materials forming said thermodeformable material are such that the melting point and the heat softening temperature of the material forming said partially transparent layer is less than the melting point and the softening temperature of the material forming said inner layer.

11. The ski of claim 10, wherein said inner layer is made of a polyamide, and said partially transparent layer is made of a block copolymer of ether and amide.

* * * * *